US005307249A

United States Patent [19]

Vanwynsberghe

[11] Patent Number: 5,307,249

[45] Date of Patent: Apr. 26, 1994

[54] FLUID DISPENSING FLASHLIGHT APPARATUS

[76] Inventor: Dennis S. Vanwynsberghe, 11630 N. 30th Pl., Phoenix, Ariz. 85028

[21] Appl. No.: 916,488

[22] Filed: Jul. 20, 1992

[51] Int. Cl.[5] ..... F21V 33/00

[52] U.S. Cl. ..... 362/96; 222/113; 222/162

[58] Field of Search ..... 362/96, 202; 222/113, 222/162, 192

[56] References Cited

U.S. PATENT DOCUMENTS 3,638,836 2/1972 Vickers ..... 362/96

3,716,170 2/1973 Mangels ..... 362/96

3,776,429 12/1973 DeLucia ..... 362/96

*Primary Examiner*—James C. Yeung

*Attorney, Agent, or Firm*—Leon Gilden

[57] ABSTRACT

An elongate tubular body includes a lens operative through batteries and an on/off switch to effect selective illumination therethrough, and further includes an elongate conduit having a forward end projecting to an exit port at and beyond the lens of the associated lens housing. A tubular extension housing mounts therewithin a pressurized cylinder containing a repelling fluid therewithin selectively directed through a valve assembly operative with the conduit to effect selective repelling of an assailant or animal in use of the flashlight structure.

4 Claims, 4 Drawing Sheets

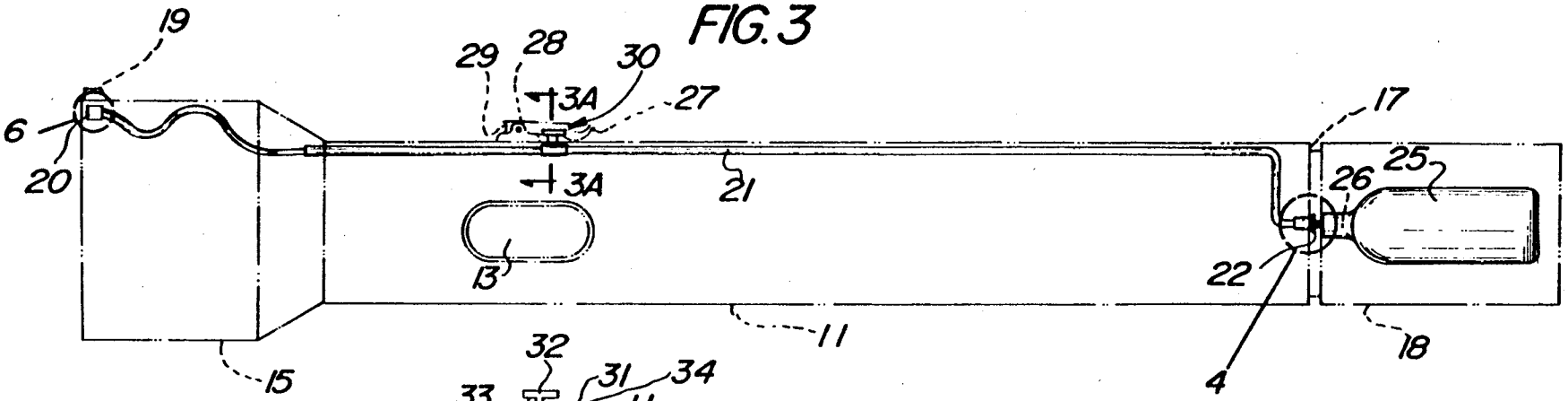
FIG. 3
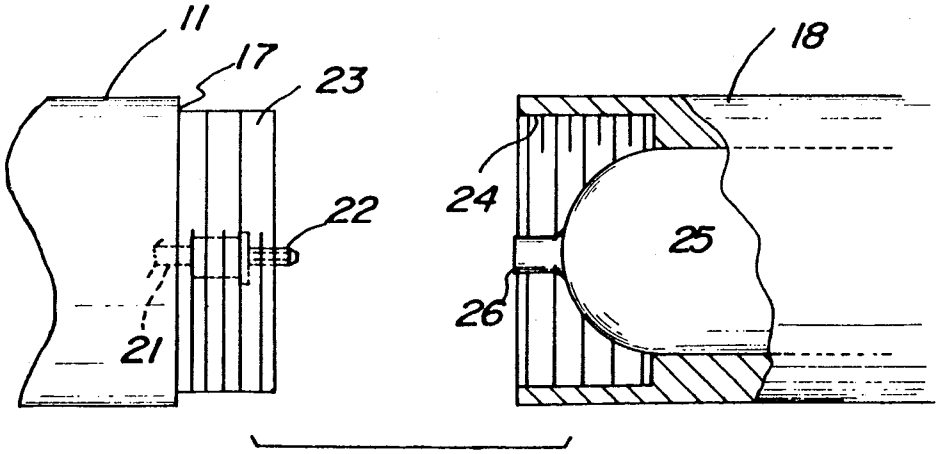
FIG. 3A
FIG. 4

FLUID DISPENSING FLASHLIGHT APPARATUS

BACKGROUND OF THE INVENTION

1. Field of the Invention

The field of invention relates to multi-purpose flashlight structure, and more particularly pertains to a new and improved fluid dispensing flashlight apparatus wherein the same is directed to effect selective dispensing and projection of a repulsion fluid relative to the flashlight organization.

2. Description of the Prior Art

The user of flashlights and the like by various law enforcement organizations as well as individuals upon encountering of an assailant or animal has heretofore been required to seek use of a repelling mechanism, wherein the instant invention attempts to overcome deficiencies of the prior art by providing for the fluid dispensing organization integrally associated with a flashlight to permit ease of dispensing of a repulsion fluid in a convenient and time saving manner. Whereas multi-purpose flashlight structure has been utilized in the prior art such as indicated in the U.S. Pat. Nos. 4,504,889; 4,835,665; 4,862,148; 4,905,130; and 4,881,155, the prior art has heretofore failed to permit the use of a repulsion fluid to be readily projected from the associated flashlight in a manner as set forth by the instant invention and in this respect, the present invention substantially fulfills this need.

SUMMARY OF THE INVENTION

In view of the foregoing disadvantages inherent in the known types of flashlight apparatus now present in the prior art, the present invention provides a fluid dispensing flashlight apparatus wherein the same permits selective dispensing of a repulsion fluid relative to an associated flashlight structure. As such, the general purpose of the present invention, which will be described subsequently in greater detail, is to provide a new and improved fluid dispensing flashlight apparatus which has all the advantages of the prior art flashlight apparatus and none of the disadvantages.

To attain this, the present invention provides an elongate tubular body including a lens operative through batteries and an on/off switch to effect selective illumination therethrough, and further including an elongate conduit having a forward end projecting to an exit port at and beyond the lens of the associated lens housing. A tubular extension housing mounts therewithin a pressurized cylinder containing a repelling fluid selective directed through a valve assembly operative with the conduit to effect selective repelling of an assailant or animal in use of the flashlight structure.

My invention resides not in any one of these features per se, but rather in the particular combination of all of them herein disclosed and claimed and it is distinguished form the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fluid dispensing flashlight apparatus which has all the advantages of the prior art flashlight apparatus and none of the disadvantages.

It is another object of the present invention to provide a new and improved fluid dispensing flashlight apparatus which may be easily and efficiently manufactured and marketed.

It is a further object of the present invention to provide a new and improved fluid dispensing flashlight apparatus which is of a durable and reliable construction.

An event further object of the present invention is to provide a new and improved fluid dispensing flashlight apparatus which is susceptible of a low cost of manufacture with regard to both materials and labor, and which accordingly is then susceptible of low prices of sale to the consuming public, thereby making such fluid dispensing flashlight apparatus economically available to the buying public.

Still yet another object of the present invention is to provide a new and improved fluid dispensing flashlight apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic side view, partially in phantom, of the invention.

FIG. 3A is an enlarged sectional view cut along a line 3A—3A in FIG. 3.

FIG. 4 is an orthographic view, partially in section, of the flashlight housing and extension housing arranged in operative communication relative to one another.

DESCRIPTION OF THE PREFERRED EMBODIMENT

Figure 1:
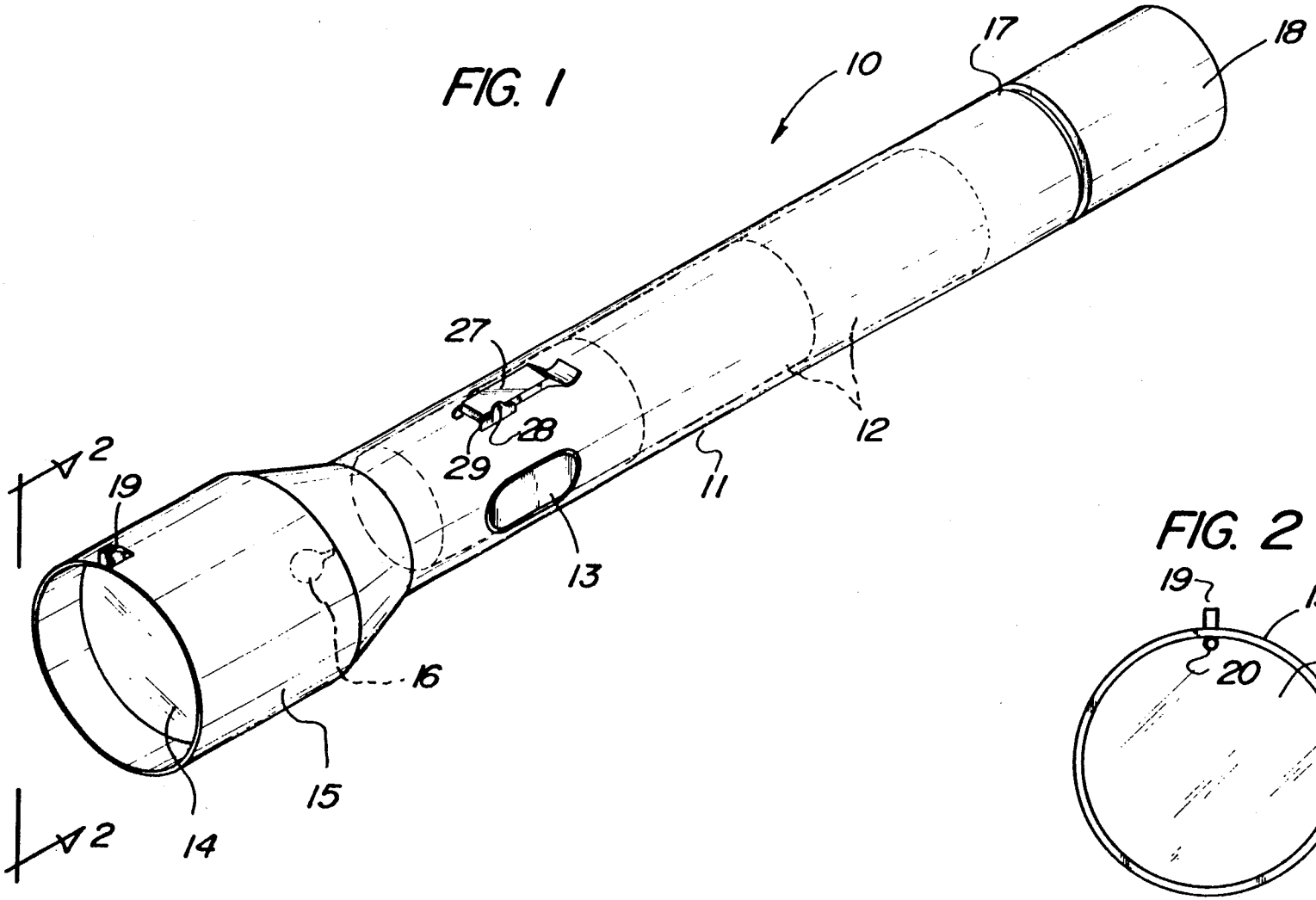
FIG. 1 is an isometric illustration of the instant invention.
Figure 2:
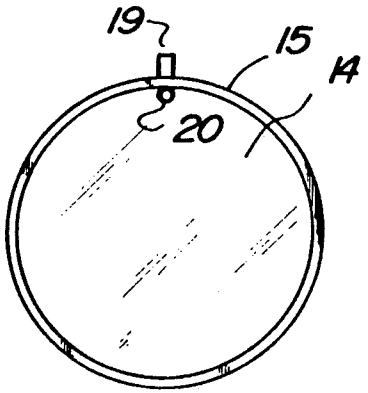
FIG. 2 is an orthographic view, taken along the lines 2—2 of FIG. 1 in the direction indicated by arrows.

With reference now to the drawings, and in particular to FIGS. 1 to 8 thereof, a new and improved fluid dispensing flashlight apparatus embodying the principles and concepts of the present invention and generally designated by the reference numeral 10 will be described.

More specifically, the fluid dispensing flashlight apparatus 10 of the instant invention essentially comprises a tubular body 11 of a first diameter containing batteries 12 therewithin operative through an on/off switch 13 to direct selective illumination of illumination bulb 16 in a conventional manner, wherein the illumination bulb 16 is positioned rearwardly of a lens 14 mounted within a cylindrical lens housing 15 mounted at a forward end of the tubular body 11. The tubular body rear end 17 includes a tubular extension housing 18 selectively directed thereon, with the extension housing 18 arranged in a longitudinally and coaxial aligned relationship relative to the tubular body 11. It should be noted that a sighting blade 19 is mounted at a cylindrical lens housing forward end 15*a* positioned in adjacency relative to a conduit exit port 20 at a first end of a fluid conduit 21 directed through the lens housing 15 and the tubular body 11, as indicated in FIG. 3, terminating in a conduit tubular piercing tip 22 projecting beyond the body rear end 17 and an associated externally threaded body extension 23. It should be noted that the tubular piercing tip 22 is mounted at a second end of the conduit 21 for projection into and the piercing of a nozzle 26 of a pressurized cylinder 25. The pressurized cylinder 25 is arranged to contain a repulsion fluid of a desired commercially available solution such as MACE or alternatively, commercially available CAPSICUM containing alcohol and red pepper in a blended inter-relationship, wherein a more humane reaction to animals to permit repulsion of an animal without harm to such animal may be utilized if desired by an individual.

The tubular extension housing 18 includes an extension housing internally threaded cylindrical receiving cavity 24 arranged for threaded engagement and securement to the externally threaded body extension 23 formed of a second diameter less than the first diameter to permit uninterrupted alignment of the exterior cylindrical wall of the tubular body 11 and the tubular extension housing 18. The pressurized cylinder 25 is accordingly longitudinally and coaxially aligned within the tubular extension housing 18 to receive the piercing tip 22 projecting beyond the externally threaded body extension 23 for reception within the nozzle 26.

The FIG. 1 notes the use of a valve cover plate 27 mounted at its forward end between parallel support flanges 29, wherein a spring hinge 28 directed between the support flanges 29 is secured to the valve cover plate to normally bias the valve cover plate in a lowered orientation, as illustrated in FIG. 1. Raising of the valve cover plate 27 exposes a valve member 30. The valve member 30 includes a valve rod 31 reciprocatably mounted through the tubular body 11 into communication with the fluid conduit 21. A valve rod head 32 (see FIG. 3A) includes a spring 33 captured between the rear valve rod head 32 and the exterior surface of the tubular body 11 to normally bias the valve rod 31 in a raised orientation. Rod ports 34 directed through the rod normally aligned within the body 11, whereupon directing the rod 31 into the conduit 21 positions the rod ports 34 within the conduit 21 to permit the projection and release of fluid from the cylinder 25 through the exit port 20.

Figure 5:
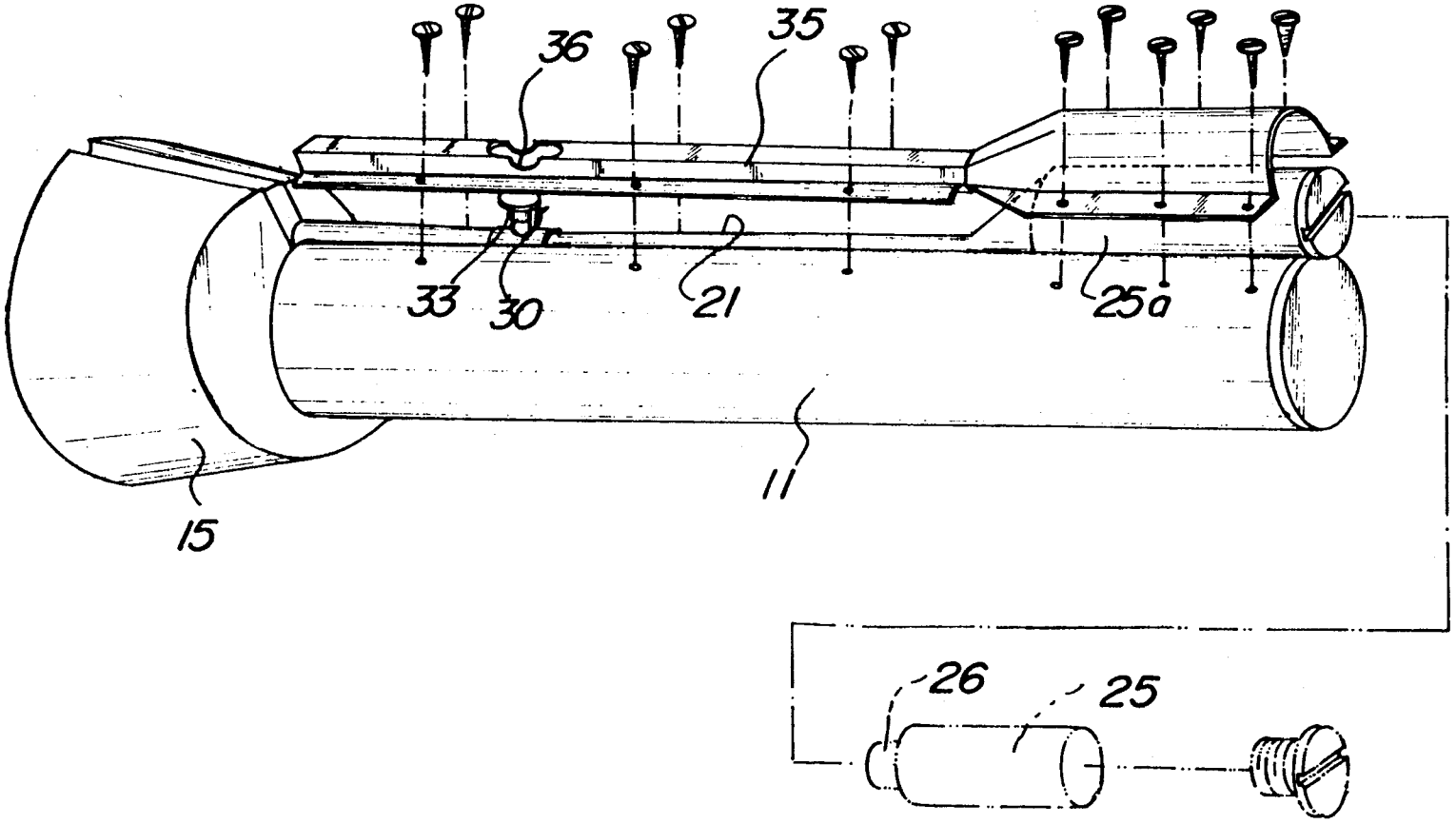
FIG. 5 is an isometric illustration of a modified aspect of the invention.

The FIG. 5 notes a modified construction of the organization, wherein a tubular rib 35 extends exteriorly of the tubular body 11 terminating in a cylindrical housing 25 to receive the pressurized cylinder 25 in cooperation with the valve member 30, in a manner as indicated above.

Figure 7:
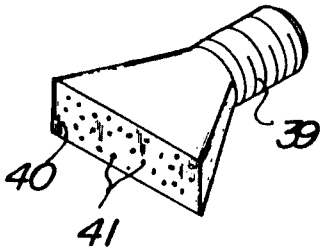
FIGS. 7 and 8 are isometric illustrations of further nozzle members arranged for utilization by the instant invention.
Figure 8:
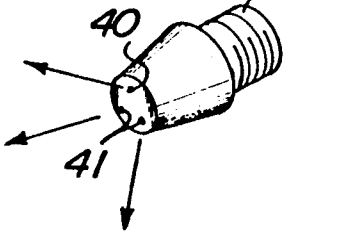
Figure 6:
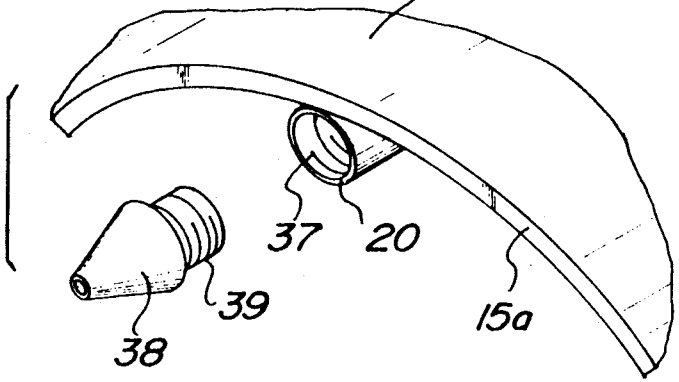
FIG. 6 is an isometric illustration of section 6 as set forth in FIG. 3.

The FIGS. 6–8 indicates the use of an internally threaded exit port portion 37 directed into the exit port 20 for reception of a nozzle tip 38. The nozzle tip 38 may be of various configurations to include a nozzle tip wall 40 having a matrix of nozzle tip apertures 41 to provide for a greater dispersion and spray about a greater array relative to a user of the flashlight. Each of the nozzle tips 38 includes an externally threaded shank 39 received within the internally threaded exit port portion 37.

As to the manner of usage and operation of the instant invention, the same should be apparent form the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fluid dispensing flashlight apparatus, comprising, an elongate tubular body, the body longitudinally aligned and including at least one battery member, and an illumination bulb operative and in electrical communication through an on/off switch to effect selective illumination of the illumination bulb, and a cylindrical lens housing mounted at a forward end of the tubular body, wherein the lens housing includes a lens housing forward end, and the tubular body having a body rear end, and an externally threaded body extension projecting rearwardly of the tubular body threadedly receiving a tubular extension housing, and a fluid container contained within the tubular extension housing, and fluid dispensing means mounted within the tubular body to effect selective dispensing of fluid from the fluid container forwardly of the lens housing forward end, and the tubular body rear end includes an externally threaded body extension coaxially aligned with the tubular body extending rearwardly and beyond the tubular body, and the tubular extension housing including an extension housing internally threaded cylindrical receiving cavity to receive the externally threaded body extension therewithin, and the fluid container coaxially aligned within the tubular extension housing and relative to the tubular body, and the fluid dispensing means including a fluid conduit directed through the tubular body having a first end positioned in adjacency to the cylindrical lens housing forward end, and a conduit second end including a conduit tubular piercing tip extending coaxially and beyond the externally threaded body extension, wherein the fluid container includes a nozzle for receiving the tubular piercing tip of the conduit second end.

2. An apparatus as set forth in claim 1 including a valve member mounted within the tubular body, the valve member including a valve rod reciprocatably mounted relative to the tubular body, and including a valve rod head positioned exteriorly of the tubular body, and a spring captured between the rod head and the tubular body, with the valve rod including at least one rod port, wherein the rod port is positioned exteriorly of the conduit in a first position and oriented within the conduit in a second depressed condition.

3. An apparatus as set forth in claim 2 including a valve cover plate positioned in a biased orientation over the valve member, wherein the cover plate includes a spring hinge mounted at a forward end of the valve cover plate, and the spring hinge is oriented between a plurality of parallel support flanges, wherein the parallel support flanges are fixedly mounted to the tubular body.

4. An apparatus as set forth in claim 3 wherein the exit port of the conduit first end includes an internally threaded exit port portion, and further including a nozzle tip having a nozzle tip shank threadedly received within the internally threaded exit port portion, and the nozzle including a nozzle tip wall, and the nozzle tip wall including a matrix of apertures directed therethrough to effect dispersion of fluid from the container.

* * * * *